United States Patent [19]

Nagase

[11] 3,990,185

[45] Nov. 9, 1976

[54] DOOR CONSTRUCTION WITH SET-IN HANDLE/HANGER BARS

[75] Inventor: Mitsuo Nagase, Kurobe, Japan

[73] Assignee: Yoshida Kogyo Kabushiki Kaisha, Tokyo, Japan

[22] Filed: June 4, 1975

[21] Appl. No.: 583,667

[30] Foreign Application Priority Data

June 14, 1974 Japan ..... 49-69925[U]

[52] U.S. Cl. ..... 49/360; 16/111 R; 49/501

[51] Int. Cl.[2] ..... E05F 11/54

[58] Field of Search ..... 49/501, 460; 52/455; 16/111 R

[56] References Cited

UNITED STATES PATENTS

| | | | |
|---|---|---|---|
| 2,701,396 | 2/1955 | Perkins et al. | 52/455 |
| 3,112,817 | 12/1963 | Critchfield | 49/460 X |
| 3,683,555 | 8/1972 | Kuniansky | 49/503 |

*Primary Examiner*—Kenneth Downey
*Attorney, Agent, or Firm*—Hill, Gross, Simpson, Van Santen, Steadman, Chiara & Simpson

[57] ABSTRACT

The construction of a paneled door or the like suitable for installation in a doorway into a bathroom. The door includes a central rail having a member of I-shaped cross section adapted to define a horizontally extending recess on each face of the door. Each recess has a pair of brackets at both ends, between which a bar extends for use either as a handle or towel hanger. The bar can be at least partly accommodated in the recess.

4 Claims, 4 Drawing Figures

DOOR CONSTRUCTION WITH SET-IN HANDLE/HANGER BARS

BACKGROUND OF THE INVENTION

Field of the Invention

This invention relates generally to door constructions, and more specifically to a door construction with a set-in horizontal bar which can be conveniently used either as a handle or hanger (hereinafter referred to as the handle/hanger bar). The door structure herein disclosed is perhaps best suited for use in conjunction with bathrooms, toilet rooms or the like.

There has been known and used a door having a horizontal bar mounted thereon for hanging towels and other articles. According to arrangement heretofore made, however, the bar protrudes too far away from the face of the door and is rather susceptible to dislodgement.

SUMMARY OF THE INVENTION

It is therefore among the objects of this invention to provide an improved door construction having a handle/hanger bar compactly and snugly mounted thereon with minimal likelihood of dislodgement, the door being favorable from both utilitarian and aesthetic points of view.

Another object of the invention is to provide a door construction constructed to permit a pair of such handle/hanger bars to be mounted on opposite faces of the door in an identical manner.

With these and other objects in view, this invention is directed to a door construction which includes a frame having a middle rail adapted to define a horizontally extending recess at least on one face of the door. Arranged at or adjacent to both ends of the recess are a pair of brackets supporting the desired handle/hanger bar therebetween. The handle/hanger bar can be at least partly received in the recess.

The features which are believed to be novel and characteristic of this invention are set forth in particular in the appended claims. The invention itself, however, both as to its general organization and the functions of the individual parts, together with the additional objects and advantages thereof, will become apparent from the following description taken in connection with the accompanying drawings in which like reference characters refer to like parts of the several views.

DESCRIPTION OF THE PREFERRED EMBODIMENT

The invention can be embodied in a glazed and/or paneled sash door suitable for installation in an entranceway to a bathroom. The door may take either of the two forms shown in FIGS. 1 and 2. Both illustrated forms can therefore be considered identical as far as this invention is concerned.

Figure 1:
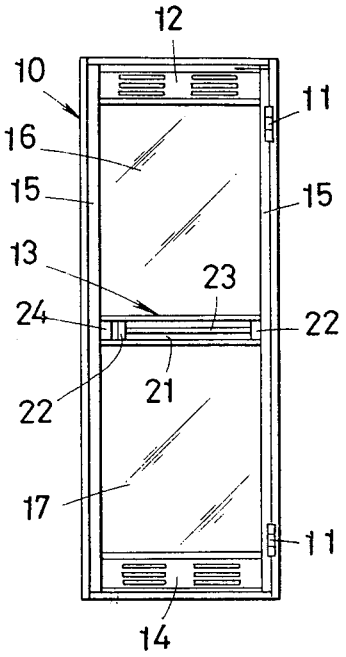
FIG. 1 is a front elevational view of a preferred form of the door construction according to this invention.
Figure 2:
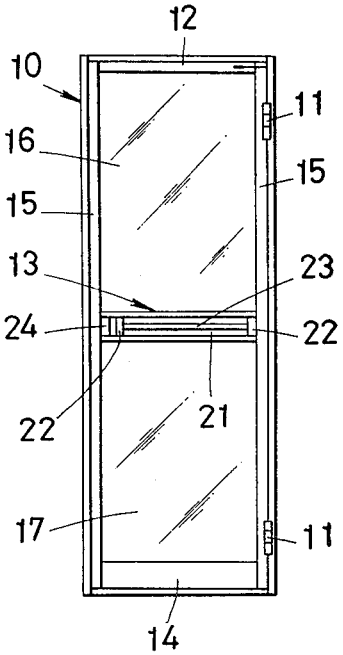
FIG. 2 is a similar view of another preferred form of the door construction according to the invention.

With reference to both FIGS. 1 and 2, the doors are hung in a generally rectangular doorframe 10 defining the doorway into the bathroom. Each door has a hinge 11 connecting it to one of the jambs of the doorframe 10 for swinging movement between closed and open positions, the door being shown in its closed position in the drawings.

Each door includes a frame which comprises a top rail 12, a middle rail 13, a bottom rail 14, and a pair of stiles 15. A pane of glass 16 or like panel is fitted in any convenient manner in the upper half of the door, that is, in the space bounded by the top rail 12, the middle rail 13, and the upper halves of the stiles 15. Another panel 17 is likewise fitted in the space bounded by the middle rail 13, the bottom rail 14, and the lower halves of the stiles 15.

Figure 3:
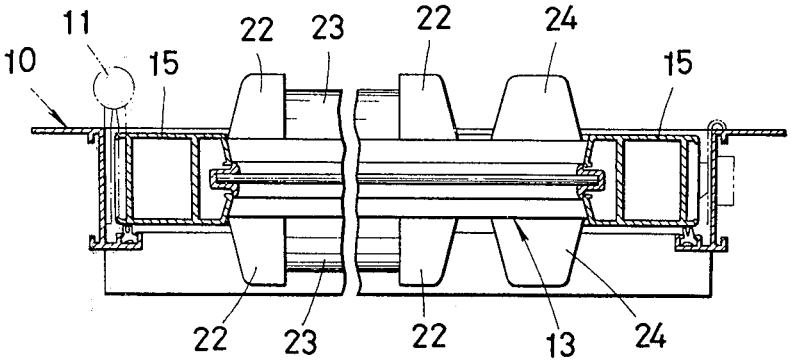
FIG. 3 is a horizontal sectional view, partly broken away, of the door constructions shown in FIGS. 1 and 2.
Figure 4:
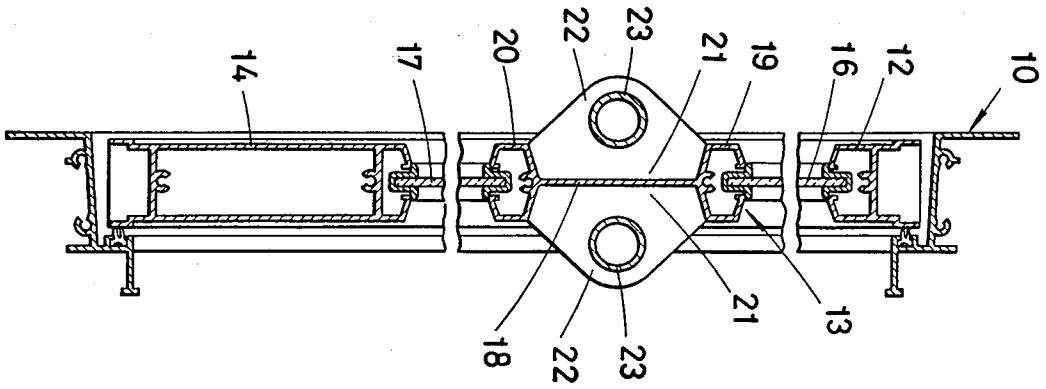
FIG. 4 is a vertical sectional view, partly broken away, of the door constructions shown in FIGS. 1 and 2.

As illustrated in greater detail in FIGS. 3 and 4, the middle rail 13 of the door is a unitary member of substantially I-shaped cross section, preferably of extruded aluminum, and comprises a web 18 and a pair of top and bottom flanges 19 and 20. The top and bottom flanges 19 and 20 are each channel shaped and extend along and embrace the peripheral bottom and top edges of the panes or panels 16 and 17, respectively.

As shown in FIG. 4 the web 18 and the flanges 19 and 20 of the middle rail 13 cooperate to define a pair of horizontally extending recesses 21 on both faces of the door. A pair of brackets 22 are formed at or adjacent to both ends of each the recesses 21 so as to partly project therefrom. A handle/hanger bar 23 of hollow, circular cross section extends between each pair of brackets 22 at a suitable spacing from the web 18. These bars 23 are at least partly received in each of the recesses 21. Screws or like fasteners, not shown, are used to secure each handle/hanger bar 23 to the brackets 22. A pair of knobs 24 associated with the usual latch mechanism are also shown to be mounted on the middle rail 13 adjacent one of the stiles 15.

The handle/hanger bars 23 are rigidly built into the door, so that they can be significantly more stably retained in position than prior bars 23. The handle/hanger bars serve as reinforcements for the web 18. More importantly, the outer edge of each handle/hanger bar 23 does not protrude too far away from the plane of the door face but their inner edges can nevertheless be sufficiently spaced from the web 18 for convenient use as a handle or hanger.

While the door construction according to this invention has been specifically shown and described, the invention itself is not to be restricted by the exact showing of the drawings or the description thereof. For example, the handle/hanger bar 23 can be disposed either on one or each side of the door. The web 18, moreover, may not necessarily lie in the vertical median plane of the door as in the drawings but can be disposed on either side of the median plane.

All these and other modifications are intended in the foregoing disclosure. It is therefore appropriate that the invention be construed broadly and in a manner consistent with the fair meaning and proper scope of the following claims.

What is claimed is:

1. A door construction having in combination:

a. a rectangular frame including a top rail, a bottom rail, and a pair of vertical stiles rigidly joined together, there being a central rail disposed between said top and bottom rails and rigidly joined thereto;

b. means defining at least one horizontally elongated recess extending along the length of said central rail;

c. a pair of brackets disposed at opposite ends of said recess and secured to said central rail, and projecting outwardly from said recess; and d. an elongated bar extending between and secured to said brackets in horizontally spaced relation to the bottom of said recess.

2. A door construction according to claim 1, said bar being at least partially disposed in said recess.

3. A door construction according to claim 1, the vertically central portion of said central rail being a web of single thickness.

4. A door construction according to claim 1 including:

a. means defining a second horizontally elongated recess extending along the length of said central rail and opening in a direction away from the first-named recess;

b. a further pair of brackets disposed at opposite ends of said second recess and secured to said central rail, and projecting outwardly from said second recess; and c. a second elongated bar extending between and secured to said further pair of brackets in horizontally spaced relation to the bottom of said second recess.

* * * * *